United States Patent [19]

Struck

[11] 4,443,316

[45] Apr. 17, 1984

[54] ELECTROLYSIS CELL WITH INTERMEDIATE CHAMBER FOR ELECTROLYTE FLOW

[75] Inventor: Bernd D. Struck, Langerwehe, Fed. Rep. of Germany

[73] Assignee: Kernforschungsanlage Jülich Gesellschaft mit beschränkter Haftung, Jülich, Fed. Rep. of Germany

[21] Appl. No.: 318,457

[22] Filed: Nov. 5, 1981

[30] Foreign Application Priority Data

Nov. 6, 1980 [DE] Fed. Rep. of Germany ..... 3041799
Nov. 6, 1980 [DE] Fed. Rep. of Germany ..... 3041823

[51] Int. Cl.[3] ..... C25B 9/00; C25B 13/02; C25B 13/08

[52] U.S. Cl. ..... 204/263; 204/282; 204/296

[58] Field of Search ..... 204/129, 252–258, 204/263–266, 296, 279, 104, 282; 428/212

[56] References Cited

U.S. PATENT DOCUMENTS 3,356,607 12/1967 Eisenmann et al. ..... 204/296 X
3,893,901 7/1975 Tejeda ..... 204/180 P X
4,124,458 11/1978 Moeglich ..... 204/283 X
4,165,248 8/1979 Darlington et al. ..... 204/296 X
4,172,774 10/1979 Moeglich ..... 204/296 X
4,242,193 12/1980 Moeglich ..... 204/296
4,361,475 11/1982 Moeglich ..... 204/296 X

*Primary Examiner*—Donald R. Valentine
*Attorney, Agent, or Firm*—Frishauf, Holtz, Goodman & Woodward

[57] ABSTRACT

The economy of production of hydrogen and sulfuric acid in a three chamber electrolysis cell in which an electrolyte flows through the intermediate chamber (11) which is bounded by ion exchanger membranes (9,10) can be improved by the provision of a porus supporting framework or skeleton (12) of graphite or of ion exchanger material against which the separators with the electrodes (7, 8) on them, can be pressed. The overall internal resistance of the cell can thus be reduced and its mechanical behavior improved. Substantial through passage porosity is desired in the supporting structure, which may be of graphite, but porous aggregates of ion exchanger material with fixedly applied or welded on separators in the form of stacked layers or rolled mats, are preferred for the relative simplicity of their provision in practice.

7 Claims, 1 Drawing Figure

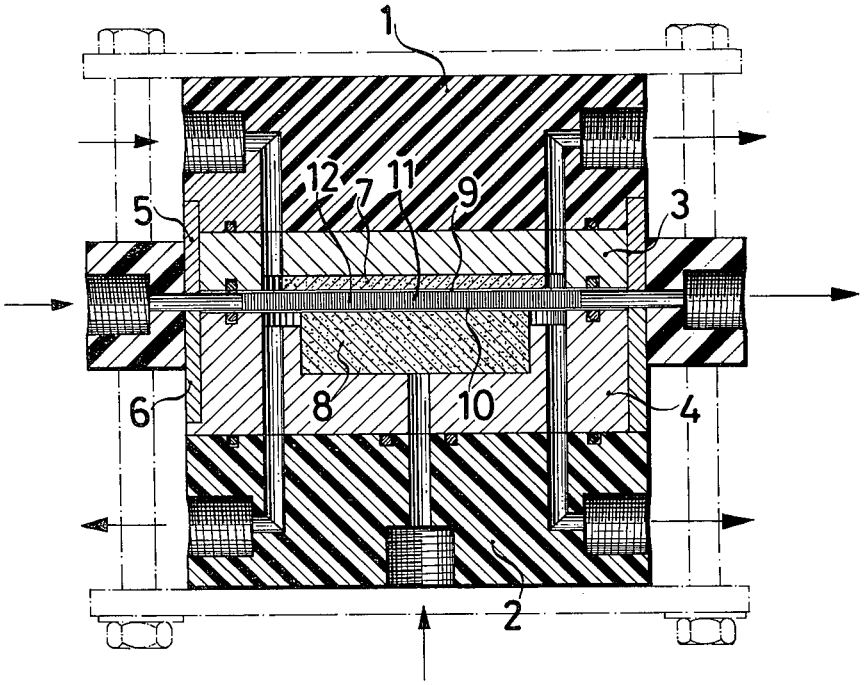
1
12
7
11
9
5
3
6
8
10
4
2

ELECTROLYSIS CELL WITH INTERMEDIATE CHAMBER FOR ELECTROLYTE FLOW

This invention concerns an electrolysis cell for the production of hydrogen and sulfuric acid out of water and sulfur dioxide, the cell having an intermediate chamber through which an electrolyte flows, which chamber separates the anode space from the cathode space and is bounded by separators constituted by ion exchange membranes. The invention relates particularly to an electrolysis cell of this kind that is designed to operated as economically as possible in the so-called "sulfuric acid hybrid closed-cycle process."

New concepts regarding energy sources have highlighted hydrogen as an energy carrier, the most economical recovery of which is a matter now under intensive investigation. The electrolytic separation of hydrogen from aqueous sulfuric acid, accompanied by anodic oxidation of sulfur dioxide to surfur trioxide is now regarded as an interesting method of production, in which the sulfur trioxide is then catalytically retransformed back into sulfur dioxide with the splitting off of oxygen which is usefully recovered.

An important objective of this process is, further, an electrolysis under favorable energy conditions which is as trouble-free as possible. That is, operation at as low a cell voltage as possible with avoidance or suppression of the transport of sulfur dioxide into the cathode space. In order to avoid this last named source of trouble, a process has already been developed by the assignee of this application in which the anode space is separated from the cathode space by an intermediate chamber bounded by two separators between which an electrolyte flows through the chamber. See U.S. patent application Ser. No. 945,693, filed Sept. 25, 1978 now U.S. Pat. No. 4,191,619. In a further development, separators for such a three chamber cell were constituted of special ion exchange membranes having an electrical conductivity that is relatively high and only slightly dependent upon the sulfuric acid concentration. See U.S. patent application Ser. No. 228,796, filed Jan. 26, 1981 now U.S. Pat. No. 4,391,682.

Further improvement of this process can be obtained by a contact that is as close as possible between the electrodes or collectors with the adjacent separators of the intermediate chamber. Difficulties arise in this case, however, because the mechanical stability of the separators is not very high, so that the use of raised application pressures is practically out of the question.

Supporting grids or frameworks (between the separators) made of polyethylene or teflon as recommended generally for aqueous electrolysis in German Pat. No. 1,546,717 would in themselves be useful for the application of pressure laterally in a three chamber cell for the recovery of hydrogen, but these structures substantially raise the overall resistance of the cell, so that such supporting frameworks have heretofore been rejected.

SUMMARY OF THE INVENTION

It is an object of the invention to provide mechanical support for the separators of a three chamber cell, to enable the electrodes to be pressed against them without the disadvantage of substantial increase in the resistance of the cell because of the presence supporting structures.

It has been found that the internal resistance of such three chamber electrolysis cells designed for hydrogen recovery is reduced and the manner of operation of the cell can be improved if a supporting framework is used which itself conducts ions and/or is of high porosity. Briefly, in the electrolysis cell of this invention a permeably porous supporting structure, of graphite or of ion exchange material is interposed between the two separators.

The porous supporting structure should take up the necessary lateral pressure (for a flat juxtaposition of the separators on the supporting structure), but nevertheless and a free volume as high as possible is desirable in between the supporting material. Holes and gaps, even when large enough to be easily visible to the unaided eye, are to be considered "pores."

Preferably the separators lie immediately against the adjacent electrodes and hence against the porous supporting framework which fills out the entire intermediate chamber while maintaining sufficient gaps for passage of an electrolyte.

In one embodiment the separators and the immediately adjacent electrodes are pressed against a supporting porous graphite body, which last should have a through-going porosity that is as high as possible, so that the intermediate electrolyte flow is not excessively limited. Porous graphite or graphite felt with about 95% "particularly useful for this purpose. In practice the through-penetrating porosity of the graphite material used should be at least 80%. This means that reticulated, or mat-like or hard-sponge bodies with the necessary stiffness are to be included in the concept of "porous" bodies, as here used.

As a result of mechanical stiffening by the supporting framework, relatively high lateral pressures are usable. The ohmic resistance of the electrolysis cell can be kept low in this manner as the result of the low specific resistance of supporting frameworks made of easily wettable graphite.

At present supporting bodies of ion exchange material seem particularly favorable, especially if this material is the same as that of the separators and can be heat-welded to the separators.

In this manner an intermediate chamber structure is provided that can be completely produced as a "sandwich" in a continuous strip, which facilitates the assembly of the cell and lowers its overall price.

On the other hand, the separators can again be simply put adjacent to the electrodes as in the case of a graphite supporting structure. The supporting framework should, with sufficient mechanical solidity, have a sufficiently through-going porosity in the direction of flow of the electrolyte between the separators (i.e. parallel to them).

Perpendicular to the separators, on the contrary, the inherently ion-conducting ion exchanger material can support electric charge transport across the intermediate chamber, so that in the case of a supporting framework of ion exchanger material a high through-going porosity is not necessary in this direction.

THE DRAWING

The advantage of the manner of operation according to the invention can best be understood with preference to an illustrative example which is described below with reference to the annexed drawing, the single FIGURE of which shows schematically (in section) a cylindrical three-chamber electrolysis cell, the axis of the cylinder being vertical on the drawing.

DESCRIPTION OF THE ILLUSTRATED EMBODIMENT

A cell, which is essentially constructed in axially symmetrical form, is held together by external plastic discs 1 and 2 (made for example, from polyvinylidene fluoride), which are adjacent on their respective internal sides to the casing halves 3 and 4 made of graphite. Two copper rings 5 and 6 reinforce the graphite and at the same time provide the electric current connections. The casing halves 3 and 4, and their respectively associated copper rings 5 and 6 are separated from each other electrically by the intermediate chamber frame of plastic containing the support body 12. The cathode 7 and the anode 8 are constituted as flow-through electrodes and lie against the separators 9 and 10 which bound the intermediate chamber 11 and are constituted of cation exchange membranes. The supply of the electrolyte flows is shown in the drawing.

The separators 9 and 10 between the individual cell chambers in the illustrated case were cation exchanger membranes of the type known as NEOSEPTA C 66-5T, on one of which a platinized graphite felt is laid as the cathode and on the other of which a graphite felt is laid as the anode.

Between the parallel membranes a porous body is provided as the supporting framework. The membrane spacing was 5 mm. Sulfuric acid (conc. 50% by weight) served as the electrolyte in the cathode chamber, 50% by weight sulfuric acid plus 0.15% by weight hydriodic acid (as homogeneous catalyst) plus $SO_2$ saturated (saturated at 1 bar) in the anode chamber and, in the intermediate chamber, 30 to 35% by weight sulfuric acid. The temperature was 90° C.

The ohmic internal resistance of the electrolysis cell can be calculated from the current-voltage characteristics of the cell and of the individual electrodes (measured against a comparison electrode). This internal resistance consists substantially entirely of the resistances of the cation exchanger membranes, of the resistance of the electrolyte in the intermediate chamber and of the transition resistances which arise through the low applied pressure of the electrodes against the membranes or of the collectors against the electrodes. In addition, as a result of the use of a supporting framework evenly distributed in the intermediate chamber, the ohmic resistance of the intermediate chamber through which the electrolyte flows, is on the one hand raised. By the use of a graphite felt with about 95% free volume as the supporting framework, this rise of the internal ohmic resistance, however, is only large enough to be fully compensated by reduction of the ohmic internal resistance by the pressing on of the electrodes or collectors against the cation exchanger membranes. Thus, the ohmic resistance of the electrolysis cell without supporting framework is about 1 ohm·cm$^2$ and with supporting framework of graphite felt, likewise about 1 ohm·cm$^2$. The electrolysis voltage is reduced from 625 mV to 565 mV at a current density of 200 mA/cm$^2$ as the result of the improved catalytic effect of the platinized graphite felt more strongly pressed as the cathode against the cathode-side cationic exchanger membrane.

In the case of a preliminary experiment with a filling of course cuttings of a cation exchanger membrane of type NEOSEPTA C 66-5T serving as a supporting framework (free volume about 30%) an ohmic internal resistance of the electrolysis cell of about 1 ohm·cm$^2$ was obtained again, in spite of the small free volume. This ohmic internal resistance can be further reduced by completing the supporting framework with cation exchanger material and thereby enhancing further the reduction of the free volume, when the specific resistance of the cation exchanger membrane is greater than the specific resistance of the electrolyte flowing through the intermediate chamber. Thus, for example, the specific resistance of 30% by weight $H_2SO_4$ at 80° C. is about 0.8 ohm·cm, while the specific resistance of the already highly conducting material NEOSEPTA C 66-5T in 30% $H_2SO_4$ is about 4 ohm·cm at 80° C.

The considerations of ohmic internal resistance of the electrolysis cell therefore provide no obstacle to the manufacture and use of a porous supporting structure of cation exchanger material which is bounded on opposite sides of the strip of material by two fixedly applied or welded-on sheets or films of the same or similar ion exchanger material.

As noted above, when the across-chamber support in the intermediate chamber is a single porous body, the body may be spongy, perforated, reticulated or in the form of a mat, provided that it is sufficiently stiff. When the support is provided by a structure composed of a number of bodies, these bodies do not need to be fastened together, since they act in compression, and may be pieces of any suitable size and shape for maintaining considerable open space between them, for example a packing of balls, and the bodies so packed may themselves be porous. The term "permeably porous" is used to designate a pore structure that is "open" or "through-going." The supporting body or structure may be thought of as a supporting skeleton.

I claim:

1. An electrolysis cell for the production of hydrogen and sulfuric acid from water and sulfur dioxide having an anode chamber, an intermediate chamber and a cathode chamber and means for causing an electrolyte to flow through said intermediate chamber as well as means for supplying electrolytes respectively to said anode and cathode chambers, said intermediate chamber being bounded on opposite sides by separators constituted of cation-exchanger membranes separating said intermediate chamber respectively from said anode and cathode chambers, said cell further comprising a permeably porous and stiff structure or body (12) of graphite extending across said intermediate chamber for supporting said separators against pressure tending to push them towards each other.

2. An electrolysis cell as defined in claim 1 in which said permeably porous and stiff structure or body (12) has a permeability or through-going porosity which, at least in a direction parallel to said separators is as great as practically possible.

3. An electrolysis cell for the production of hydrogen and sulfuric acid from water and sulfur dioxide having an anode chamber, an intermediate chamber and a cathode chamber and means for causing an electrolyte to flow through said intermediate chamber as well as means for supplying electrolytes respectively to said anode and cathode chambers, said intermediate chamber being bounded on opposite sides by separators constituted of cation-exchanger membranes separating said intermediate chamber respectively from said anode and cathode chambers, said cell further comprising a permeably porous and stiff structure or body (12) which substantially completely fills said intermediate chamber and is made either of graphite or of cation-exchanger material, said cell anode and cathode electrodes (7,8) lying directly and flush against the respective separators (9,10) bounding the anode and cathode chambers, and said porous and stiff structure or body supporting said separators against pressure tending to push them towards each other.

4. An electrolysis cell as defined in claim 3 in which said electrodes are pressed against said separators.

5. An electrolysis cell for the production of hydrogen and sulfuric acid from water an sulfur dioxide having an anode chamber, an intermediate chamber and a cathode chamber and means for causing an electrolyte to flow through said intermediate chamber as well as means for supplying electrolytes respectively to said anode and cathode chambers, said intermediate chamber being bounded on opposite sides by separators constituted of cation-exchanger membranes separating said intermediate chamber respectively from said anode and cathode chambers, said cell further comprising a permeably porous and stiff structure or body (12) being made of the same cation-exchanger material as the separators, being firmly bonded to said separators, and extending across said intermediate chamber for supporting said separators against pressure tending to push them towards each other.

6. An electrolysis cell as defined in claim 5 in which said permeably porous and stiff structure or body (12) is fused or welded with the cation-exchanger membranes constituting said separators.

7. An electrolysis cell for the production of hydrogen and sulfuric acid from water and sulfur dioxide having an anode chamber, an intermediate chamber and a cathode chamber and means for causing an electrolyte to flow through said intermediate chamber as well as means for supplying electrolytes respectively to said anode and cathode chambers, said intermediate chamber being bounded on opposite sides by separators constituted of cation-exchanger membranes separating said intermediate chamber respectively from said anode and cathode chambers, said cell further comprising a permeably porous and stiff structure or body (12) consisting either of graphite or of cation-exchanger material and extending across said intermediate chamber for supporting said separators against pressure tending to push them towards each other, the spacing between said separator membranes (9,10) being as small as practically possible while still allowing a sufficient electrolyte flow to pass through said porous and stiff structure or body for preventing passage of sulfur dioxide from said anode chamber to said cathode chamber.

* * * * *